US007448918B2

(12) United States Patent
Lappoehn

(10) Patent No.: US 7,448,918 B2
(45) Date of Patent: Nov. 11, 2008

(54) PLUG-IN-CONNECTOR

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 11/977,554

(22) Filed: Oct. 25, 2007

(65) Prior Publication Data

US 2008/0124980 A1 May 29, 2008

(30) Foreign Application Priority Data

Nov. 23, 2006 (DE) ..... 10 2006 055 694

(51) Int. Cl.
*H01R 24/00* (2006.01)

(52) U.S. Cl. ..... 439/660; 439/733.1

(58) Field of Classification Search ..... 439/733.1, 439/746, 660

See application file for complete search history.

(56) References Cited

U.S. PATENT DOCUMENTS

| | | | | |
|---|---|---|---|---|
| 4,188,715 | A * | 2/1980 | Ammon et al. | 29/884 |
| 5,879,200 | A * | 3/1999 | Sugie | 439/733.1 |
| 6,129,591 | A | 10/2000 | Czeschka | |
| 6,152,782 | A * | 11/2000 | Volkert et al. | 439/733.1 |
| 6,305,949 | B1 * | 10/2001 | Okuyama et al. | 439/75 |
| 7,021,975 | B2 * | 4/2006 | Lappohn | 439/733.1 |

FOREIGN PATENT DOCUMENTS

| | | |
|---|---|---|
| DE | 30 42 293 | 5/1982 |
| DE | 295 11 998 | 2/1996 |
| DE | 198 07 713 | 6/1999 |
| DE | 103 21 348 | 12/2004 |

* cited by examiner

*Primary Examiner*—Tho D. Ta
*Assistant Examiner*—Travis Chambers
(74) *Attorney, Agent, or Firm*—Collard & Roe, P.C.

(57) ABSTRACT

The invention relates to a plug-in connector (10) with a connector housing (12) having at least one rearwardly open contact cavity (30, 40, 50, 60, 70, 80), which comprises at least one contact element receiving means (31, 51, 71*a*, 71*b*) for receiving a contact element (11*a*, 11*b*, 11*c*), and at least one guide groove (32*a*, 32*b*, 42*a*, 42*b*, 52*a*, 52*b*, 52*c*, 52*d*, 62*a*, 62*b*, 62*c*, 62*d*, 72*a*, 72*b*, 72*c*, 72*d*, 82*a*, 82*b*, 82*c*, 82*d*) for guiding a contact element locking means (21*a*, 21*b*, 21*c*) provided on the contact element (11*a*, 11*b*, 11*c*). A first guide groove (32*a*, 42*a*, 52*a*, 62*a*, 72*a*, 82*a*) arranged on one side of the contact element receiving means (31, 51, 71*a*, 71*b*) is provided on its forward end with a first abutment (34*a*, 44*a*, 54*a*, 64*a*, 82*a*) for a forward contact shoulder (22*a*, 22*b*, 22*c*) of the contact element locking means (21*a*, 21*b*, 21*c*). A further guide groove (32*b*, 42*b*, 52*b*, 52*c*, 52*d*, 62*b*, 62*c*, 62*d*, 72*b*, 72*c*, 72*d*, 82*b*, 82*c*, 82*d*) provided on at least one further side of the contact element receiving means (31, 51, 71*a*, 71*b*) is likewise provided on its forward end with a further abutment (34*b*, 44*b*, 54*b*, 54*c*, 54*d*, 64*b*, 64*c*, 64*d*, 74*b*, 74*c*, 74*d*, 84*b*, 84*c*, 84*d*) for the forward contact shoulder (22*a*, 22*b*, 22*c*), for alternative assembly of the contact element (11*a*, 11*b*, 11*c*) in a position rotated by 90 degrees/180 degrees. In case of repair, the contact elements (11*a*, 11*b*, 11*c*) can be exchanged from the front (15) of the plug-in connector (10).

8 Claims, 8 Drawing Sheets

PLUG-IN-CONNECTOR

CROSS REFERENCE TO RELATED APPLICATIONS

Applicant claims priority under 35 U.S.C. §119 of German Application No. 10 2006 055 694.1 filed Nov. 23, 2006.

PRIOR ART

The present invention relates to a plug-in connector as defined in the preamble of the independent claim.

Utility Patent DE 295 11 998 describes a plug-in connector that comprises exchangeable contact clips. In the assembled condition of the plug-in connector, the contact clips are arranged in contact cavities of a connector housing that are freely accessible from the rear for placement of the contact clips. Each of the contact clips is provided on its rear end with a spring leg which in the assembled condition of the contact clip is introduced into and held in a recess in a holding strip that is provided for all contact clips. For exchanging a contact clip, one initially bends the spring leg off the holding strip. Thereafter an extracting tool, designed as a pin wrench, is introduced into the contact clip to be exchanged from the rear. The extracting tool engages the contact clip from behind and entrains the contact clip as it is pulled out. A new contact clip can then be inserted into the contact cavity from the rear of the connector housing, and the spring leg can be fitted again in the recess of the holding strip.

Patent Application DE 30 42 293 describes a plug-in connector with components that can be exchanged in case of repair. The plug-in connector comprises a plurality of contact pins that are firmly arranged in a contact block described as insulating element. In the assembled condition of the plug-in connector, the contact block is arranged in a connector housing. For establishing a plugged connection, there is provided a corresponding plug-in connector that likewise comprises a plurality of contact pins firmly arranged in a contact block. Plugged connection is rendered possible by the fact that a further insulating element, described as adapter body, in which contact tubes are arranged is associated either to the one plug-in connector or to the corresponding plug-in connector. The further insulating element, with the contact tubes arranged therein, is provided in the housing of that plug-in connector to which the further insulating element is to be associated, where it is screwed to the insulating element that contains the contact pins. The contact pins of the respective plug-in connector are inserted into the contact tubes once the further insulating element has been mounted. In the plugged condition of the plug-in connector, the contact pins of the corresponding plug-in connector are likewise inserted into the contact tubes to establish the electric connection via the contact tubes. In the first place, the further insulating element, with the contact tubes arranged therein, can be exchanged from the front of the plug-in connector due to the screwed connection. In addition, even the insulating parts with the contact pins, arranged in the housings of the plug-in connector, can be exchanged as a complete unit for which purpose the connections of the contact pins on the rear of the plug-in connector, for example soldered joints with cables or with a board, have to be detached.

Patent Application DE 103 21 348 describes a housing of a plug-in connector in which contact cavities are provided for receiving contact elements. Such a contact cavity comprises various guide grooves and/or recesses that allow different contact elements to be fitted in one and the same contact cavity. For example, there may be provided contact cavity areas intended to receive rectangular contact elements that differ one from the other as regards the design of enlarged portions or of contact shoulders. Mounting of the different contact elements, if any, is effected in each case from the rear of the connector housing.

Due to mechanical loading of the plug-in connector or to a fault encountered in establishing the plugged connection, for example if the plug-in connectors are fitted askew, defects may occur on individual contact elements. In cases where an exchange of individual contact elements is not possible, it is then necessary to exchange the complete plug-in connector, which is connected with high expense. The exchange is especially complicated where the plug-in connector contains a very great number of contact elements. Such a plug-in connector has been described, for example, in Patent Application DE 198 07 713, where plugged connections are made between backplanes and plug-in cards of what is known as compact PCI systems. Exchanging individual contact elements may fail especially because the plug-in connector is connected with a board by a soldered joint so that the rear of the plug-in connector no longer is freely accessible unless the soldered joint of the plug-in connector is unsoldered.

Now, it is the object of the present invention to provide a plug-in connector that allows different ways of mounting a contact element and that can be easily repaired.

That object is achieved by the features defined in the independent claim.

DISCLOSURE OF THE INVENTION

The plug-in connector with connector housing according to the invention starts out from a design where the connector housing has at least one rearwardly open contact cavity which comprises at least one contact element receiving means, for receiving one contact element, and at least one guide groove for guiding a contact element locking means provided on the contact element. A first guide groove provided on one side of the contact element receiving means is provided on its forward end with an abutment for a forward contact shoulder of the contact element locking means. In order to permit the contact elements to be mounted alternatively in a position rotated by 90 degrees/180 degrees, a further guide groove, likewise provided with an abutment for the contact shoulder on its forward end, is provided on at least one further side of the contact element receiving means.

The features provided according to the invention allow the at least one contact cavity of the connector housing to be fitted with a contact element optionally in a first or in one further position. The invention provides a connector housing that need not be changed for different contact element mounting configurations. It is thus possible to react quickly to special requirements regarding the mounting arrangement of the contact elements. The fact that different housing designs are no longer required provides advantages with respect to series production and storekeeping.

The rearwardly open design of the contact cavities allows the contact elements to be easily fitted in the connector housing by a force-saving insertion process.

One advantage of the plug-in connector according to the invention is derived from the fact that even a completely assembled plug-in connector may still be altered because the contact elements can be pulled off the contact cavity to the rear without any problem for being inserted, if necessary, in a position rotated by 90 degrees or 180 degrees. For example, contact elements of a first length may be exchanged for contact elements of another length.

An especially substantial advantage of the plug-in connector according to the invention results from the fact that individual contact elements can be exchanged even in the assembled condition of the plug-in connector when the contact elements have already been soldered to a printed circuit board.

In case of repair a broken, worn out or otherwise defective contact element can be pulled off the connector housing from the front and can be bent or, especially, broken off depending on the particular design of the first abutment on which the forward contact shoulder of the contact element has been supported on the occasion of the initial assembly process. Given the fact that at least one further guide groove and one further abutment is provided in a position rotated by 90 degrees or 180 degrees, the contact element can be introduced into the contact cavity once more from the front of the plug-in connector and can be rotated by 90 degrees or 180 degrees, it being assumed in this case that the further abutment on which the forward contact shoulder of the contact element is now to be supported will not be damaged during renewed assembly of the contact element from the front of the plug-in connector.

Advantageous further developments and configurations of the plug-in connector according to the invention are apparent from the dependent claims.

One embodiment provides that the guide grooves are provided in rotationally symmetrical arrangement relative to the sides of the contact element receiving means. This permits those parts of the contact element that are arranged in the contact cavity in the assembled condition to be given different configurations.

According to one embodiment the contact element receiving means has a square cross-section, for receiving a square contact element. According to an alternative embodiment the contact element receiving means has a rectangular cross-section, for receiving a rectangular contact element. This permits the plug-in connector according to the invention to be adapted to differently configured contact elements that may be optimized, for example, in response to particular demands with respect to current carrying capacity or high-frequency properties. A contact element of rectangular configuration provides, for example, particularly low inductance values so that the assembled plug-in connector has especially good high-frequency properties.

Particular flexibility regarding the assembly process is derived from the fact that the contact cavity comprises two contact element receiving means that overlap each other in crosswise arrangement. This permits the contact element to be mounted optionally in a position rotated by 90 degrees or by 180 degrees. In the case of that configuration, three additional abutments are available in addition to the first abutment so that following the first assembly of a contact element that contact element may subsequently be repaired three times by rotation. According to one low-cost practical implementation it is provided that the contact cavity comprises only one second guide groove on the opposite side of the contact element receiving means in addition to the first guide groove.

One embodiment relates to the strength of the first abutment which preferably is selected to ensure that the fitted contact element can be pulled off the contact cavity from the front of the plug-in connector by application of a defined force, between a minimum pull-out force and a maximum force.

The strength of the first abutment can be defined for repair cases so that when the contact element is being pulled off from the front the abutment will either bend or break. It is accepted in this case that once the contact element has been pulled off the first abutment can no longer be used.

According to an advantageous further development of the plug-in connector according to the invention at least one contact element is fitted in the plug-in connector. The contact element comprises a contact element locking means having a front contact shoulder that supports and locates the contact element on the surface of the abutment in the assembled condition. Preferably, the contact element locking means has a rear beveled portion of specific configuration.

The strength of the at least one further abutment, that serves as a new abutment in case of repair, and the rear beveled portion are adjusted one to the other so that when fitting the contact element from the front of the plug-in connector the rear beveled portion will bend the further abutment only slightly.

Certain exemplary embodiments of the invention will be described hereafter and are illustrated in the drawing in which.

Figure 1:
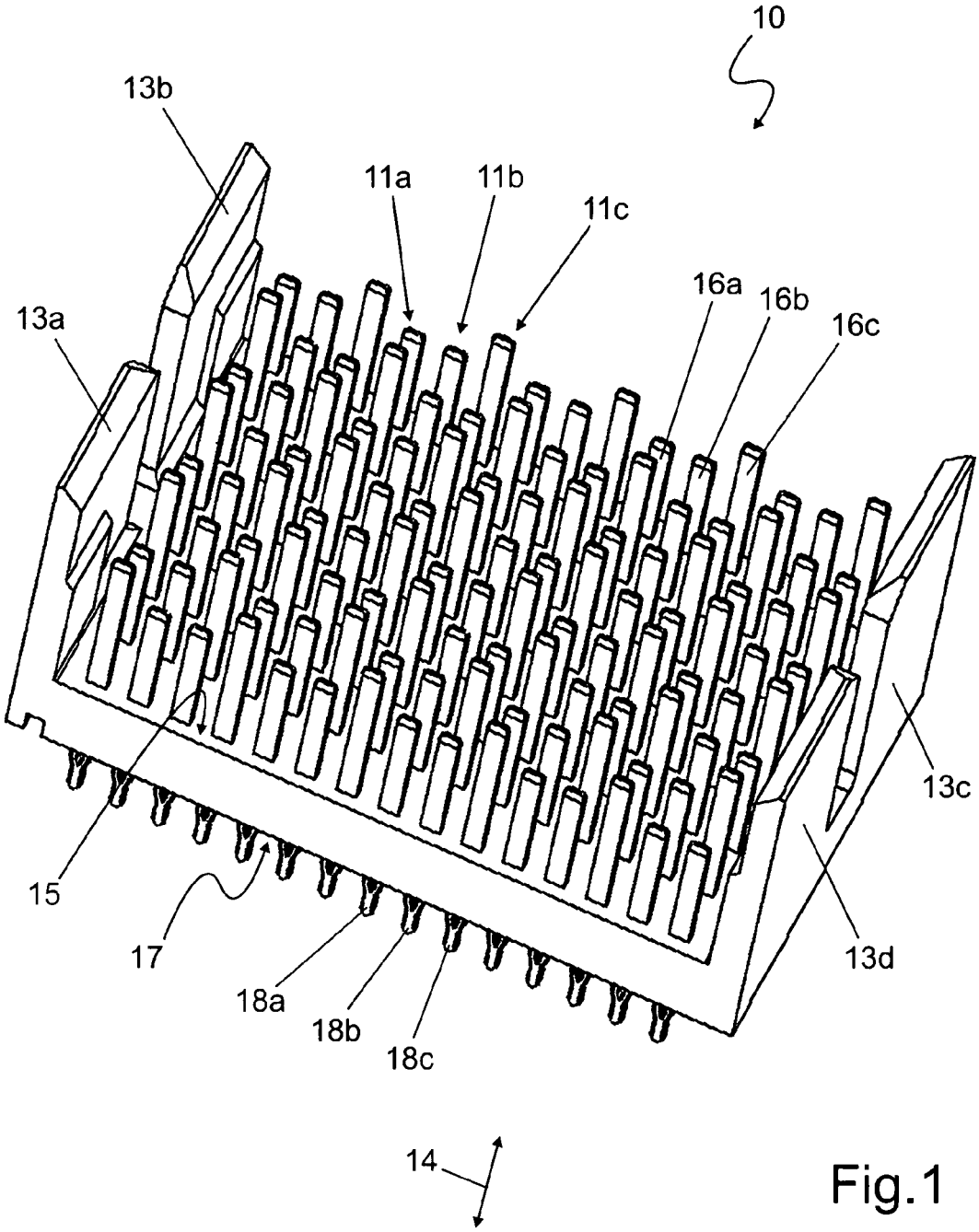
FIG. 1 shows a perspective front view of a plug-in connector according to the invention, with components mounted.

FIG. 1 shows a perspective front view of a plug-in connector 10 according to the invention with components mounted. The plug-in connector 10 comprises a plurality of contact elements 11*a*, 11*b*, 11*c* arranged in a connector housing 12. In the illustrated example, the connector housing 12 comprises lateral guide elements 13*a*, 13*b*, 13*c*, 13*d* which, just as the contact elements 11*a*, 11*b*, 11*c*, extend in the plugging direction 14. It is assumed for purposes of the illustrated embodiment that contact pins 16*a*, 16*b*, 16*c* of the contact elements 11*a*, 11*b*, 11*c* are arranged on the front 15 of the plug-in connector 10, and that soldered joints 18*a*, 18*b*, 18*c* of the contact elements 11*a*, 11*b*, 11*c* are provided on the rear of the plug-in connector 10.

Figure 2:
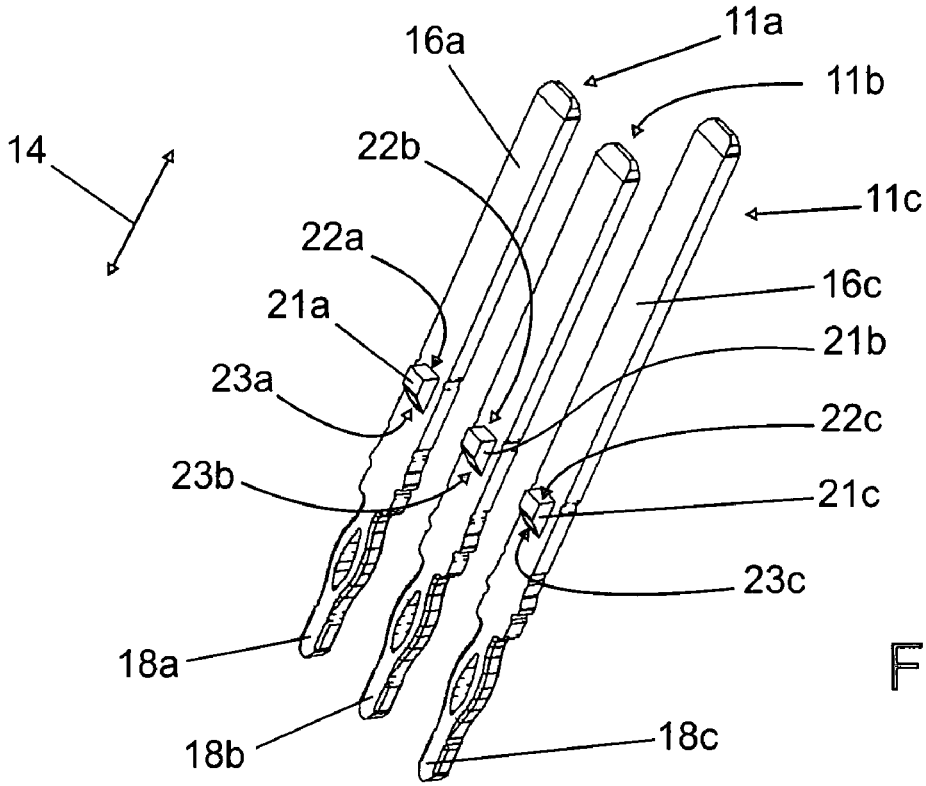
FIGS. 2 and 3 show perspective views of contact elements.
Figure 3:
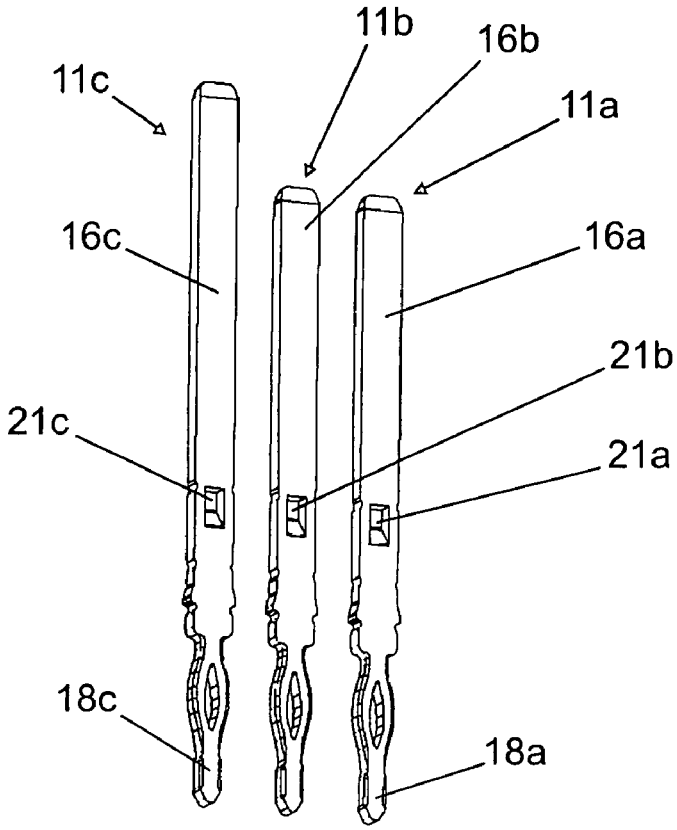

FIGS. 2 and 3 show perspective views of three contact elements 11*a*, 11*b*, 11*c* arranged in the plug-in connector 10 one adjacent the other, for example. Those parts illustrated in FIGS. 2 and 3 that are identical to the parts shown in FIG. 1 are designated by the same reference numerals. That convention also applies to the following Figures. For purposes of the illustrated embodiment it is assumed that the contact elements 11*a*, 11*b*, 11*c* are implemented as contact pins 16*a*, 16*b*, 16*c*. The contact elements 11*a*, 11*b*, 11*c* of the plug-in connector 10 according to the invention may be configured alternatively as contact clips. The contact pins 16*a*, 16*b*, 16*c* may have different lengths.

The contact elements 11*a*, 11*b*, 11*c* comprise contact element locking means 21*a*, 21*b*, 21*c*that are formed on one side of the blade contacts 16*a*, 16*b*, 16*c*, for example by embossing. Each of the contact element locking means 21*a*, 21*b*, 21*c* contains a forward contact shoulder 22*a*, 22*b*, 22*c* as well as a rear beveled portion 23*a*, 23*b*, 23*c*. The contact element locking means 21*a*, 21*b*, 21*c* coact with abutments that are shown in the Figures that follow.

Figure 4:
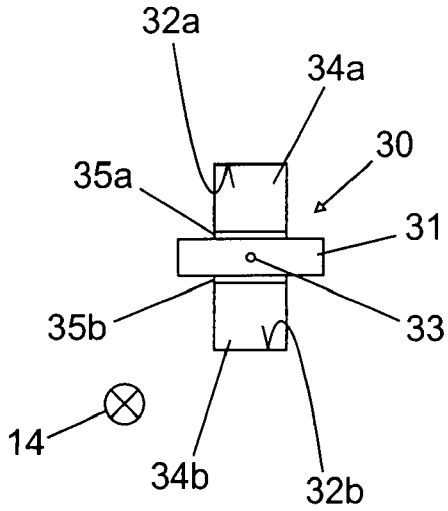
FIGS. 4 to 9 show top views of the rear sides of differently configured contact cavities.

FIG. 4 shows a detail of a top view of the rear side 17 of the plug-in connector 10 according to the invention. There can be seen in the Figure a rearwardly open contact cavity 30, extending in the plugging direction 14, which comprises a contact element receiving means 31 as well as a first guide groove 32*a* arranged on one side of the contact element receiving means 31 and a second guide groove 32*b* arranged on the opposite side of the contact element receiving means 31. The first guide groove 32*a* is delimited on its forward end by a first abutment 34*a*, while the second guide groove 32*b* is delimited by a second abutment 34*b*. The two guide grooves 32*a*, 32*b* are provided in mirror-symmetrical arrangement, related to a center axis 33 of the contact element receiving means 31.

The contact element receiving means 31 has a rectangular cross-section for receiving a contact element 11*a*, 11*b*, 11*c*. When a contact element 11*a*, 11*b*, 11*c* is initially mounted in the contact cavity 30, the contact element locking means 21*a*, 21*b*, 21*c* of the contact element 11*a*, 11*b*, 11*c* may be inserted either into the first guide groove 32*a* or into the second guide groove 32*b*. That choice makes production of the plug-in connector 10 more flexible. For purposes of the illustrated embodiment it is assumed that the contact element locking means 21*a*, 21*b*, 21*c* engages the first guide groove 32*a*. The second guide groove 32*b* remains empty in that case.

The forward contact shoulder 22*a*, 22*b*, 22*c* of the contact element 11*a*, 11*b*, 11*c* is supported by the first abutment 34*a* in the mounted condition so that the contact element 11*a*, 11*b*, 11*c* is fixed in place in the contact cavity 30 and is secured from slipping off the plug-in connector 10 toward the front. The abutment 34*a* contributes toward providing a specifically determinable pull-out force necessary to pull the contact element 11*a*, 11*b*, 11*c* off the plug-in connector 10 toward the front.

Due to mechanical strains acting on the contact elements 11*a*, 11*b*, 11*c* of the plug-in connector 10, individual contact elements 11*a*, 11*b*, 11*c* may get bent or may break. In cases where the plug-in connector 10 has to stand numerous plugging operations it may happen that the surface of individual contact elements 11*a*, 11*b*, 11*c* gets damaged. Exchanging the complete plug-in connector 10 would then be extremely complicated due to the great number of existing soldered joints by which the solder lug terminals 18*a*, 18*b*, 18*c* of the contacts 11*a*, 11*b*, 11*c* are soldered to a board not shown in detail, for example a backplane.

By giving the plug-in connector 10 at least one further guide groove 32*b*, in addition to the first guide groove 32*a*, a possibility to repair the plug-in connector 10 is provided where only the damaged contact element 11*a*, 11*b*, 11*c* has to be unsoldered. After having been unsoldered, that contact element 11*a*, 11*b*, 11*c* is then pulled off the contact cavity 30 from the front 15 of the plug-in connector 10 in the plugging direction 14, against the resistance of the abutment 34*a*. In doing so, the pull-out force has to be overcome.

The behavior of the abutment 34*a* as the contact element 11*a*, 11*b*, 11*c* is pulled out can be predefined specifically by specifying the strength of the abutment 34*a*. For example, the strength can be specified in such a way that only the abutment 34*a* will be deformed by the forward contact shoulder 22*a* during the pulling-off operation. Alternatively, the strength may be specified so that the forward contact shoulder 22*a*, 22*b*, 22*c* will break the abutment 34*a* during the pulling-out operation.

The contact element 11*a*, 11*b*, 11*c* is then turned, in the example illustrated in FIG. 4 by 180 degrees, for example. Thereafter, the contact element 11*a*, 11*b*, 11*c* is introduced once more into the contact cavity 30 by inserting it in the plugging direction 14 from the front 15 of the plug-in connector 10. During this operation, the rear beveled portion 23*a*, 23*b*, 23*c* of the contact element locking means 21*a*, 21*b*, 21*c* has the function to bend the further abutment 34*b* of the further guide groove 32*b*—the second abutment 34*b* of the second guide groove 32*b* in the illustrated example—until the contact element 11*a*, 11*b*, 11*c* can be pushed into the contact element receiving means 31 of the contact cavity 30 without damaging the further abutment 34*b*. Following the repair, the forward contact shoulder 22*a*, 22*b*, 22*c* can then be supported on the further abutment 34*b* in the mounted condition.

The rear beveled portion 23*a*, 23*b*, 23*c* as well as the strength of the at least one further abutment 34*b* must be adjusted conveniently. Pushing in the contact element 11*a*, 11*b*, 11*c* from the front 15 of the plug-in connector 10 in case of repair is facilitated by the fact that the first abutment 34*a* either no longer exists, having been broken off, or has been bent off by deformation at least to an extent that the contact element 11*a*, 11*b*, 11*c* can spring into the first guide groove 32*a* at least slightly when the contact element locking means 21*a*, 21*b*, 21*c* passes the further abutment 34*b*.

In order to facilitate assembly of the contact element 11*a*, 11*b*, 11*c*, there may be further provided air gaps 35*a*, 35*b* between the assembled contact elements 11*a*, 11*b*, 11*c* and the surfaces of the abutments 34*a*, 34*b*. At least, the air gap 35*b* is provided in the at least one further guide groove 32*b*.

Figure 5:
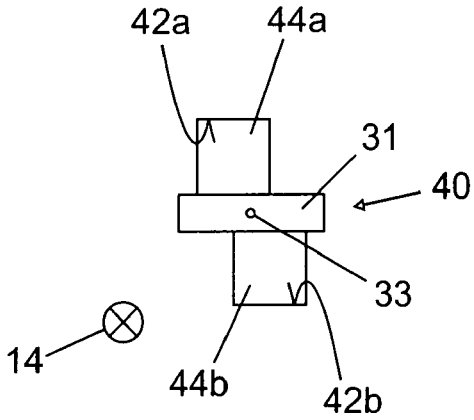

FIG. 5 shows one embodiment of a contact cavity 40 which likewise starts out from a rectangular contact element receiving means 41 and two guide grooves 42*a*, 42*b* with the two abutments 44*a*, 44*b* arranged on opposite sides of the contact element receiving means 41. It is assumed for purposes of that embodiment illustrated in FIG. 5 that the guide grooves 42*a*, 42*b* are no longer mirror-symmetrical relative to the center line 43 of the contact element receiving means 41, as in the embodiment illustrated in FIG. 4, but are instead merely provided in rotationally symmetrical arrangement. The embodiment of the contact cavity 40 is designed for coaction with contact element locking means 21*a*, 21*b*, 21*c* arranged laterally of a center line of the contact elements 11*a*, 11*b*, 11*c*, not shown in detail.

Figure 6:
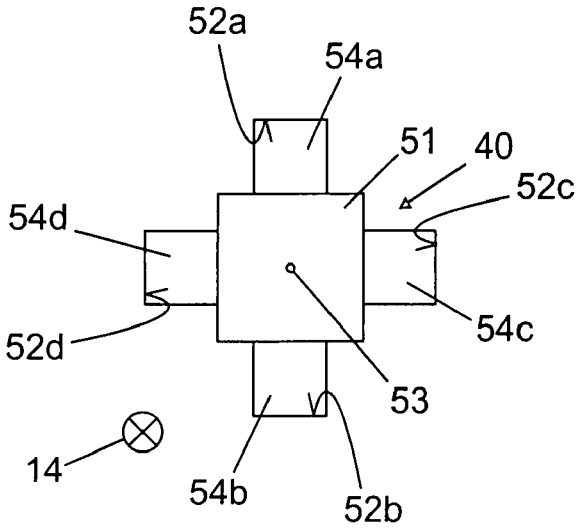

FIG. 6 shows an embodiment of a contact cavity 50 having a square cross-section for receiving a contact element 11*a*, 11*b*, 11*c* of square cross-section. Further, it is assumed that four guide grooves 52*a*, 52*b*, 52*c*, 52*d* are provided one opposite the other in mirror-symmetrical arrangement, related to the center line 53 of the contact cavity 51.

A contact element 11*a*, 11*b*, 11*c* with square cross-section may be suitable for carrying higher currents especially at lower frequencies. Compared with a rectangular cross-section, as used in the previously described configurations, inductance is however increased in this case. The configurations illustrated in FIGS. 4 and 5, which are based on rectangular contact elements 11*a*, 11*b*, 11*c*, are therefore especially suitable for realizing plug-in connections with good high-frequency properties where low inductance should be guaranteed up to high frequencies. A uniform shape of the contact elements 11*a*, 11*bc*, 11*c* likewise helps achieve low inductance for the entire plug-in connector 10.

The embodiment illustrated in FIG. 6, having more than two guide grooves 52*a*, 52*b*, 52*c*, 52*d*, requires more space in the connector housing 12, but on the other hand provides the possibility of multiple repairs, i.e. three repairs in the illustrated embodiment.

Figure 7:
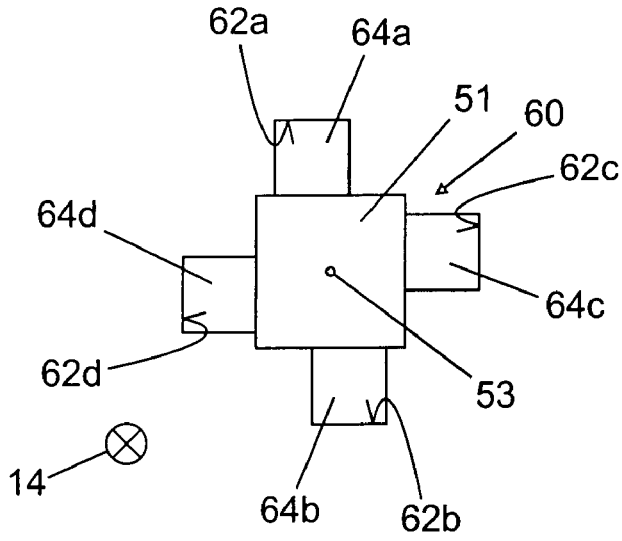

FIG. 7 shows an embodiment similar to that of FIG. 6, it being assumed for purposes of FIG. 7 that the guide grooves 62*a*, 62*b*, 62*c*, 62*d* are no longer arranged mirror-symmetrically relative to a center line 53 of the contact element receiving means 51, but are now merely provided in rotationally symmetrical arrangement.

Figure 8:
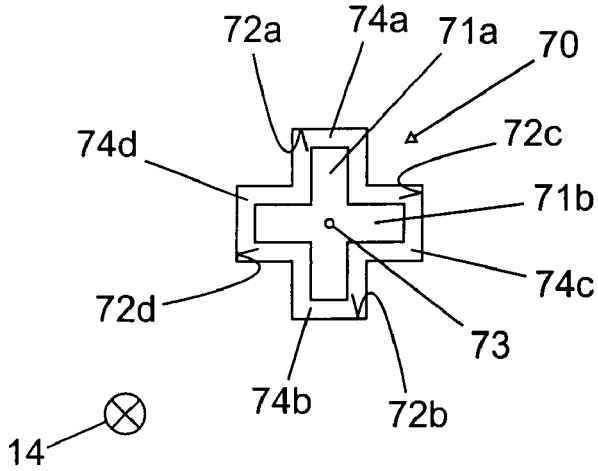

FIG. 8 shows a further embodiment of a contact cavity 70 which is based on two contact element receiving means 71*a*, 71*b* of rectangular cross-sections provided in crosswise arrangement. It is assumed for purposes of that embodiment that the center axes 73 of both contact element receiving means 71*a*, 71*b* coincide one with the other.

The embodiment illustrated in FIG. 8 increases especially the choices for mounting the contact elements 11*a*, 11*b*, 11*c* during production of the plug-in connector 10 according to the invention. When the use of contact elements 11*a*, 11*b*, 11*c* of rectangular cross-section is envisaged, a universal connector housing 12 can be prefabricated, and the decision if the contact elements 11*a*, 11*b*, 11*c* are to be oriented in a first direction or to be mounted in a position rotated by 90 degrees can be taken at the time the contact elements 11*a*, 11*b*, 11*c* are mounted in the connector housing 12. Rotation by 180 degrees is anyway possible at any time.

Figure 9:
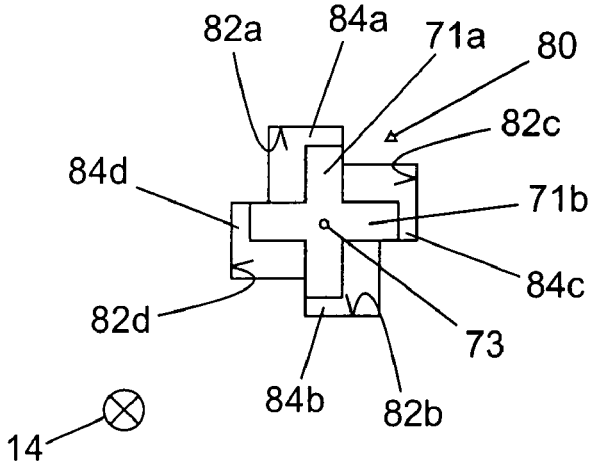

FIG. 9 likewise shows an embodiment of a contact cavity 80 with two contact cavities 71*a*, 71*b* of rectangular cross-sections provided in crosswise arrangement. The guide grooves 82*a*, 82*b*, 82*c*, 82*d* are no longer provided in mirror-symmetrical arrangement relative to the center axis 73 of the contact element receiving means 71*a*, 71*b*—as in the embodiment illustrated in FIG. 8—but are now merely provided in rotationally symmetrical arrangement.

Figure 10:
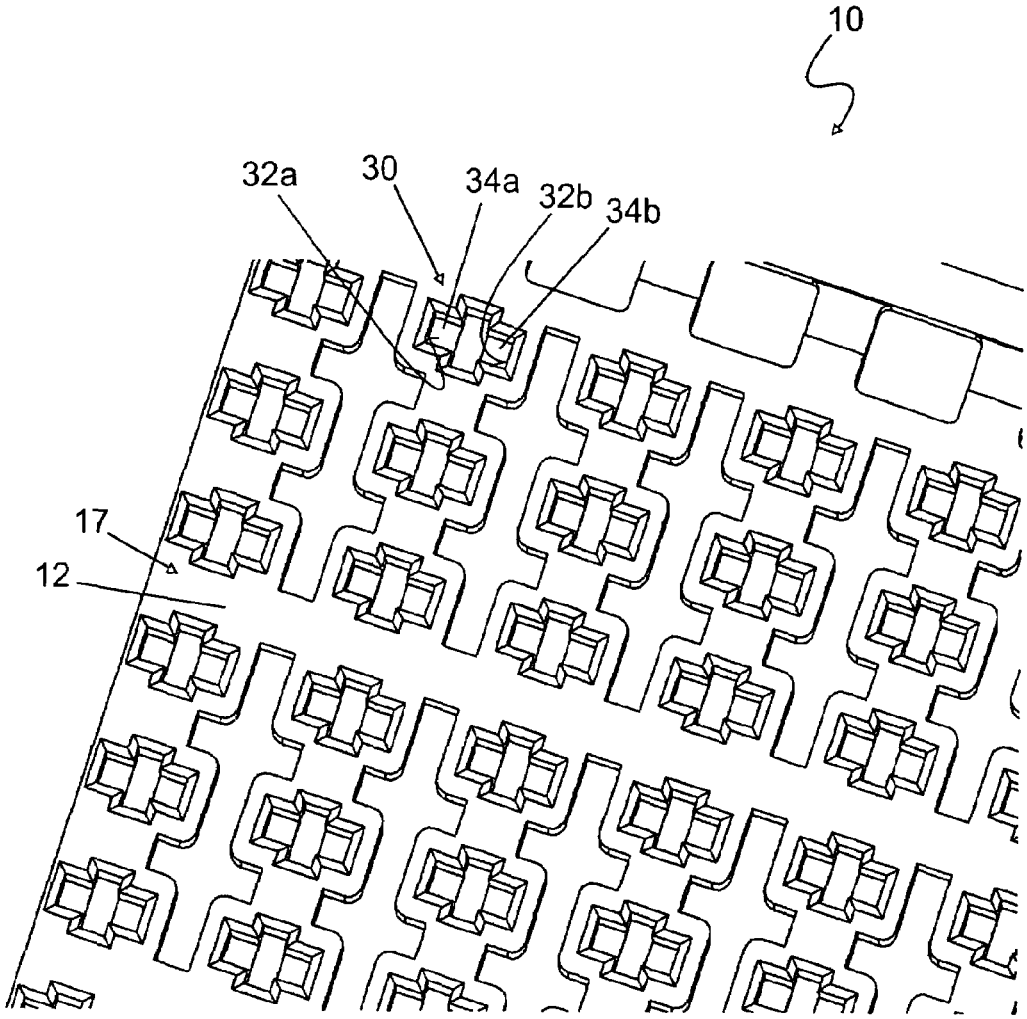
FIG. 10 shows a top view of the rear side of a plug-in connector according to the invention, with no components mounted.

FIG. 10 shows a perspective view of the rear side 17 of the plug-in connector 10 with no contact elements 11*a*, 11*b*, 11*c* mounted. That illustration is based on a contact cavity 30 of which a top view is shown in FIG. 4. FIG. 10 illustrates the positions of the abutments 34*a*, 34*b* of the guide grooves 32*a*, 32*b*.

Figure 11:
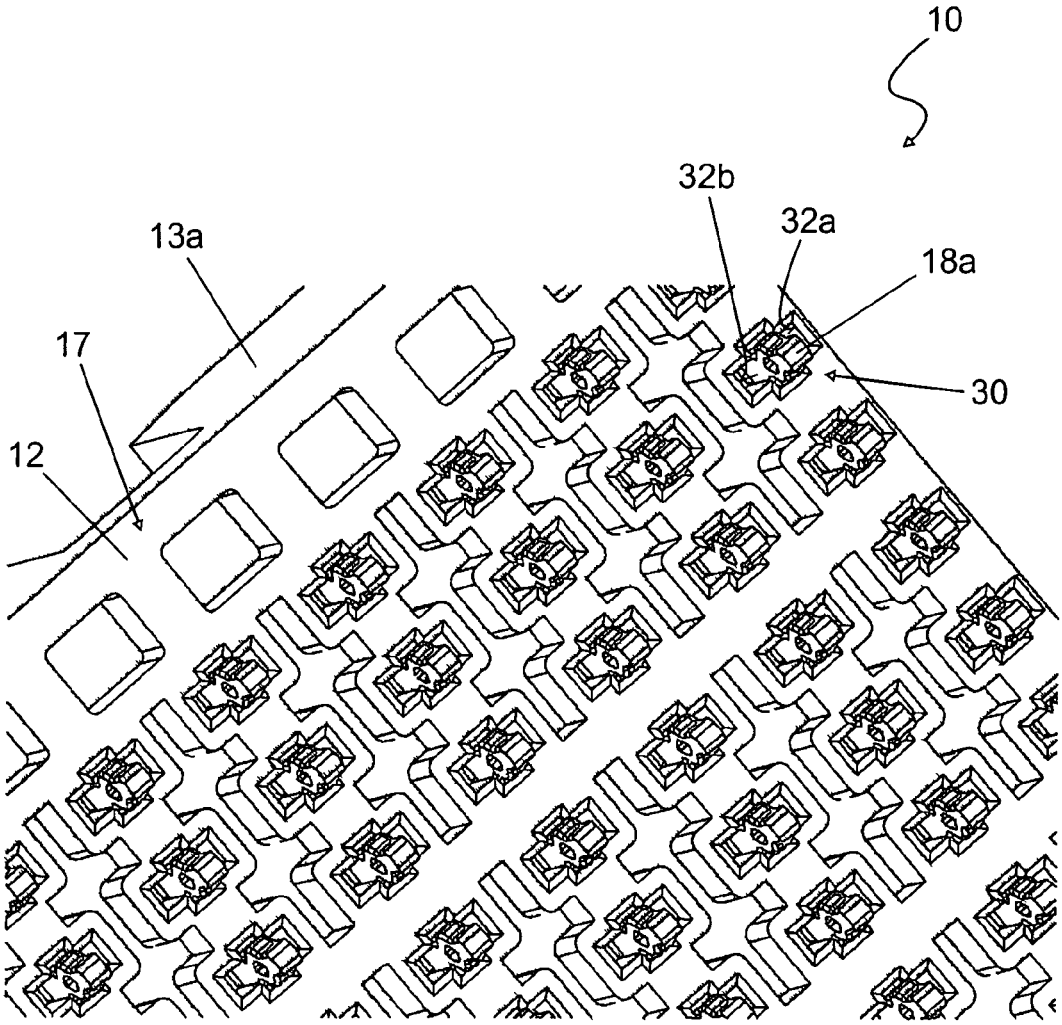
FIG. 11 shows a top view of the rear side of a plug-in connector according to the invention, with components mounted.

FIG. 11 shows a perspective view of the rear side 17 of the plug-in connector 10, with contact elements 11*a*, 11*b*, 11*c* mounted. Only the solder lug terminals 18*a*, 18*b*, 18*c* of the contact elements 11*a*, 11*b*, 11*c* project from the rear of the connector housing 12.

Figure 12:
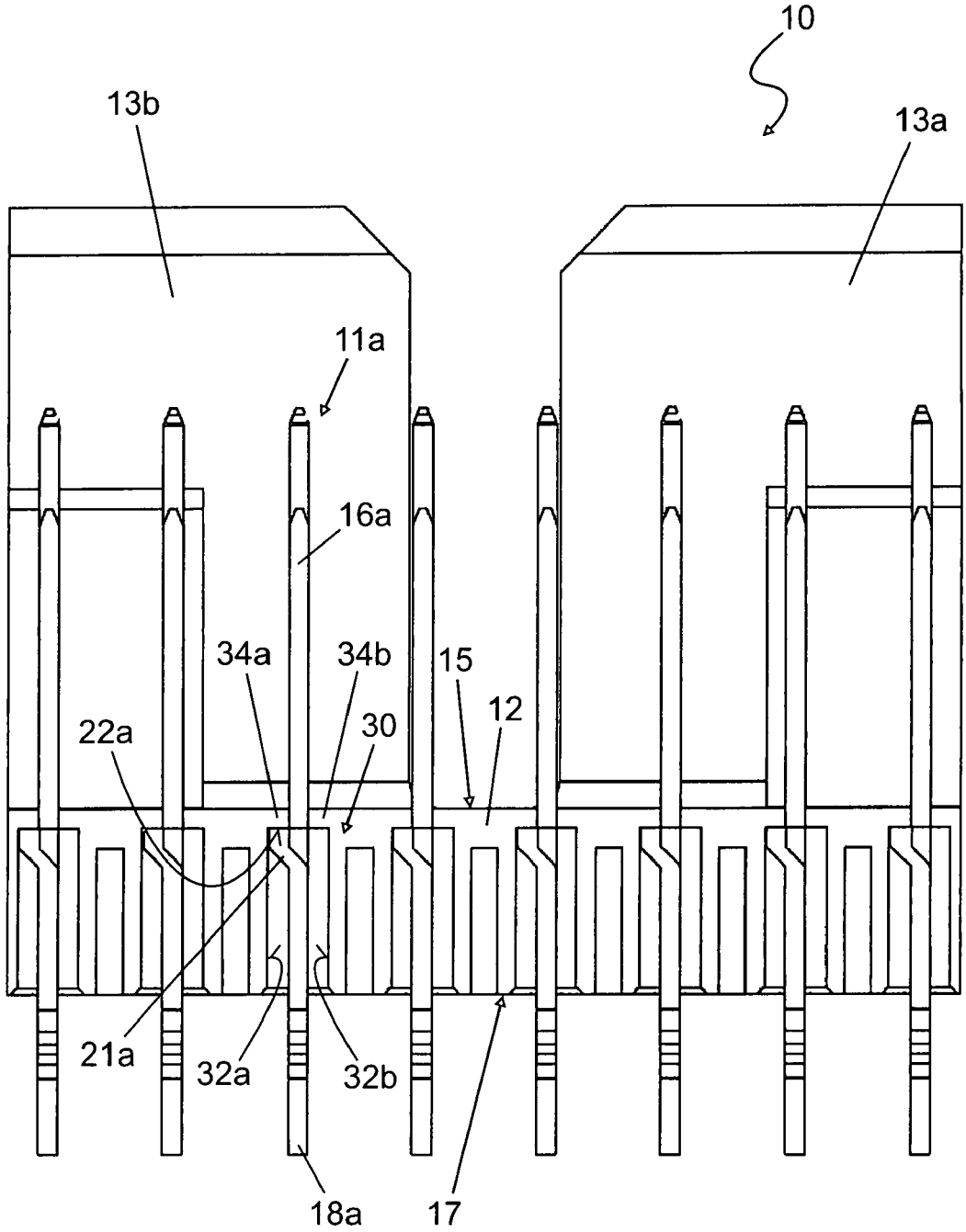
FIG. 12 shows a cross-section through a plug-in connector according to the invention.

FIG. 12 shows a cross-section through the plug-in connector 10. Especially, FIG. 12 provides a view into a contact cavity 30, 40, 50, 60, 70, 80, the illustrated embodiment being based on the contact cavity 30 illustrated in FIG. 4. The contact elements 11*a*, 11*b*, 11*c* are shown in mounted condition where the forward contact shoulders 22*a*, 22*b*, 22*c* of the contact element locking means 21*a*, 21*b*, 21*c* are in contact with the first abutments 34*a* of the first guide grooves 32*a*.

Figure 13:
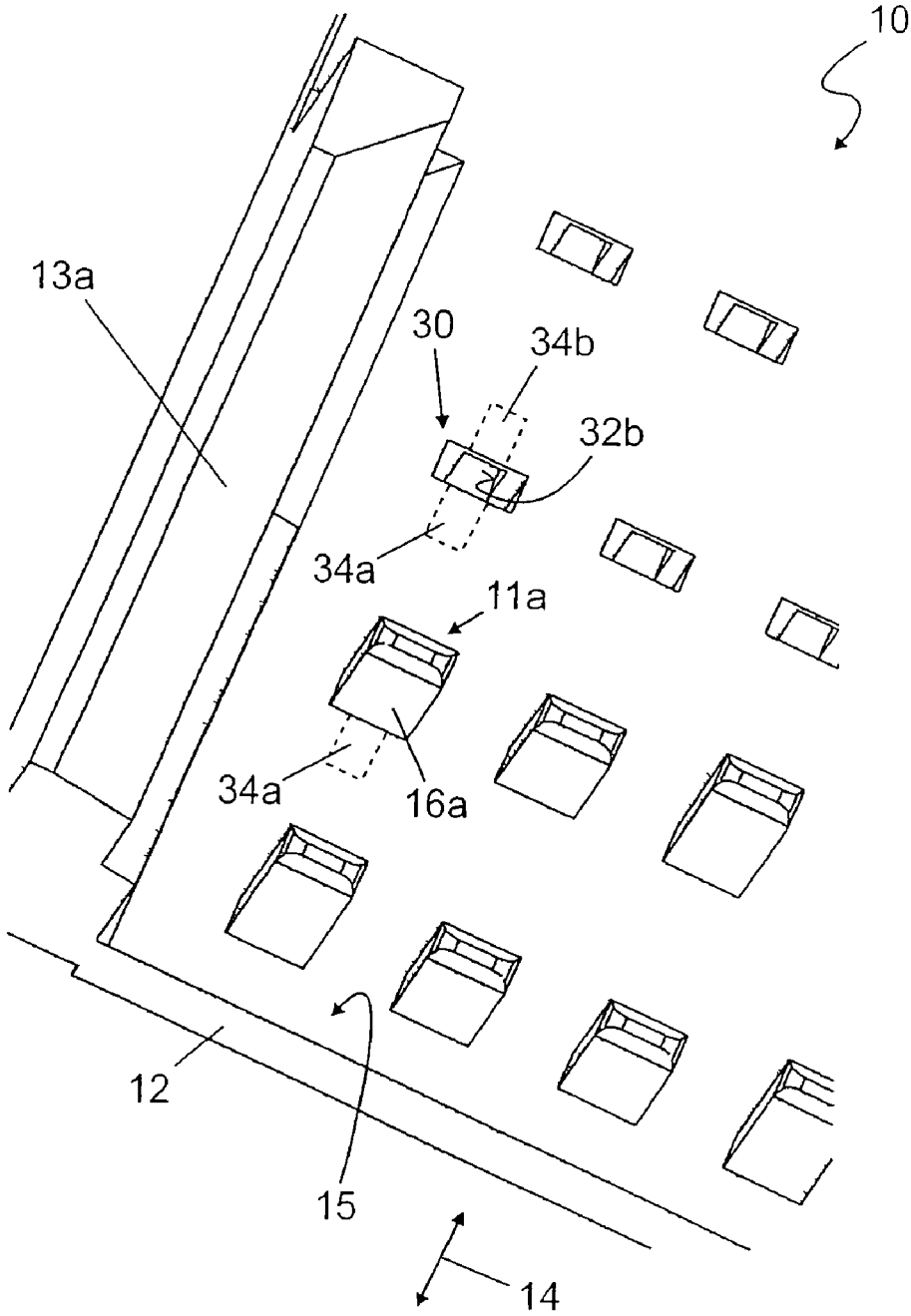
FIG. 13 shows a perspective front view of a plug-in connector according to the invention, with part of the components mounted.

FIG. 13 shows a perspective view of the front 15 of the connector housing 12 with part of the contact elements 11*a* mounted. There can be seen contact elements 11*a* that are implemented as contact blades 16*a* of rectangular cross-section. Further, it is assumed that a contact cavity 30 is provided that is configured similar to that shown in FIG. 4. Consequently, the abutments 34*a*, 34*b* of the guide grooves 32*a*, 32*b* are located on both broad sides of the contact blades 16*a*.

The invention claimed is:

1. Plug-in connector with a connector housing (12) having at least one rearwardly open contact cavity (30, 40, 50, 60, 70, 80) which comprises at least one contact element receiving means (31, 51, 71*a*, 71*b*) for receiving a contact element (11*a*, 11*b*, 11*c*), and at least one guide groove (32*a*, 32*b*, 42*a*, 42*b*, 52*a*, 52*b*, 52*c*, 52*d*, 62*a*, 62*b*, 62*c*, 62*d*, 72*a*, 72*b*, 72*c*, 72*d*, 82*a*, 82*b*, 82*c*, 82*d*) for guiding a contact element locking means (21*a*, 21*b*, 21*c*) provided on the contact element (11*a*, 11*b*, 11*c*), wherein a first guide groove (32*a*, 42*a*, 52*a*, 62*a*, 72*a*, 82*a*) is arranged on one side of the contact element receiving means (31, 51, 71*a*, 71*b*), which is provided on its forward end with a first abutment (34*a*, 44*a*, 54*a*, 64*a*, 74*a*, 84*a*) for a forward contact shoulder (22*a*, 22*b*, 22*c*) of the contact element locking means (21*a*, 21*b*, 21*c*), and a further guide groove (32*b*, 42*b*, 52*b*, 52*c*, 52*d*, 62*b*, 62*c*, 62*d*, 72*b*, 72*c*, 72*d*, 82*b*, 82*c*, 82*d*) is provided on at least one further side of the contact element receiving means (31, 51, 71*a*, 71*b*), which groove is likewise provided on its forward end with a further abutment (34*b*, 44*b*, 54*b*, 54*c*, 54*d*, 64*b*, 64*c*, 64*d*, 74*b*, 74*c*, 74*d*, 84*b*, 84*c*, 84*d*) for the forward contact shoulder (22*a*, 22*b*, 22*c*), for alternative assembly of the contact element (11*a*, 11*b*, 11*c*) in a position rotated by 90 degrees/180 degrees, wherein the strength of the first abutment (34*a*, 44*a*, 54*a*, 64*a*, 74*a*, 84*a*) is defined so that when the contact element (11*a*, 11*b*, 11*c*) is being pulled off a forward contact shoulder (22*a*, 22*b*, 22*c*) of the contact element locking means (21*a*, 21*b*, 21*c*) will bend or break the first abutment (34*a*, 44*a*, 54*a*, 64*a*, 74*a*, 84*a*), wherein the contact element locking means (21*a*, 21*b*, 21*c*) has a rear beveled portion (23*a*, 23*b*, 23*c*) and wherein the strength of at least one further abutment (34*b*, 44*b*, 54*b*, 54*c*, 54*d*, 64*b*, 64*c*, 64*d*, 74*b*, 74*c*, 74*d*, 84*b*, 84*c*, 84*d*) and the rear beveled portion (23*a*, 23*b*, 23*c*) are adjusted one to the other so that when fitting the contact element (11*a*, 11*b*, 11*c*) from the front (15) of the plug-in connector (10) the rear beveled portion (23*a*, 23*b*, 23*c*) will bend the further abutment (34*b*, 44*b*, 54*b*, 54*c*, 54*d*, 64*b*, 64*c*, 64*d*, 74*b*, 74*c*, 74*d*, 84*b*, 84*c*, 84*d*).

2. The plug-in connector as defined in claim 1, wherein the guide grooves (32*a*, 32*b*, 42*a*, 42*b*, 52*a*, 52*b*, 52*c*, 52*d*, 62*a*, 62*b*, 62*c*, 62*d*, 72*a*, 72*b*, 72*c*, 72*d*, 82*a*, 82*b*, 82*c*, 82*d*) are provided in rotationally symmetrical arrangement relative to a center axis (33, 53, 73) of the contact element receiving means (31, 51, 71*a*, 71*b*).

3. The plug-in connector as defined in claim 1, wherein the contact element receiving means (31, 51, 71*a*, 71*b*) has a square cross-section, for receiving a square contact element (11*a*, 11*b*, 11*c*).

4. The plug-in connector as defined in claim 1, wherein the contact element receiving means (31, 51, 71*a*, 71*b*) has a rectangular cross-section, for receiving a rectangular contact element (11*a*, 11*b*, 11*c*).

5. The plug-in connector as defined in claim 1, wherein the contact cavity (30, 40, 50, 60, 70, 80) comprises two contact element receiving means (71*a*, 71*b*), that overlap each other in crosswise arrangement, for receiving a rectangular contact element (11*a*, 11*b*, 11*c*) optionally in a position rotated by 90 degrees or by 180 degrees.

6. The plug-in connector as defined in claim 1, wherein the contact cavity (30, 40, 50, 60, 70, 80) comprises only one second guide groove (32*a*, 42*a*) on the opposite side of the contact element receiving means (31) in addition to the first guide groove (32*a*, 42*a*).

7. The plug-in connector as defined in claim 1, wherein the strength of at least the first abutment (34*a*, 44*a*, 54*a*, 64*a*, 74*a*, 84*a*) preferably is selected to ensure that the fitted contact element (11*a*, 11*b*, 11*c*) can be pulled off the contact cavity (30, 40, 50, 60, 70, 80) from the front (15) in the plugging direction (14) by application of a defined force, between a minimum pull-out force and a maximum force.

8. The plug-in connector as defined in claim 1, wherein at least one contact element (11*a*, 11*b*, 11*c*) is provided in a contact element receiving means (31, 51, 71*a*, 71*b*) of a contact cavity (30, 40, 50, 60, 70, 80) and the contact element (11*a*, 11*b*, 11*c*) comprises a contact element locking means (21*a*, 21*b*, 21*c*) having a front contact shoulder (23*a*, 22*b*, 22*c*) for being supported on the abutment (34*a*, 34*b*, 44*a*, 44*b*, 54*a*, 54*b*, 54*c*, 54*d*, 64*a*, 64*b*, 64*c*, 64*d*, 74*a*, 74*b*, 74*c*, 74*d*, 84*a*, 84*b*, 84*c*, 84*d*).

* * * * *